252-95 AU 157 EX
1/6/87 XR 4,634,544

United States Patent [19]
Weber et al.

[11] Patent Number: 4,634,544
[45] Date of Patent: Jan. 6, 1987

[54] DETERGENT COMPOSITION FOR COLORED FABRICS

[75] Inventors: Rudolf Weber, Duesseldorf; Winfried Pochandke, Baumberg; Hans Andree, Leichlingen; Hermann Anzinger, Duesseldorf, all of Fed. Rep. of Germany

[73] Assignee: Henkel Kommanditgesellschaft auf Aktien, Duesseldorf, Fed. Rep. of Germany

[21] Appl. No.: 718,394

[22] Filed: Apr. 1, 1985

[30] Foreign Application Priority Data

Apr. 9, 1984 [DE] Fed. Rep. of Germany ..... 3413292

[51] Int. Cl.[4] ..... C11D 3/32; C11D 7/18; C11D 3/37

[52] U.S. Cl. ..... 252/99; 252/95; 252/98; 252/106; 252/107; 252/110; 252/117; 252/141; 252/174.12; 252/174.22; 252/174.23; 252/174.24; 252/526; 252/544; 252/542; 252/524; 252/102; 252/DIG. 14

[58] Field of Search ..... 252/526, 544, 542, 174.22, 252/141, DIG. 2, DIG. 14, 174.23, 174.24, 95, 99, 174.12, 117, 98, 106, 107

[56] References Cited

U.S. PATENT DOCUMENTS

| | | | |
|---|---|---|---|
| 2,926,154 | 2/1980 | Keim | 260/29.2 |
| 2,969,302 | 1/1961 | Green | 162/164 |
| 3,663,444 | 5/1972 | Schmadel | 252/99 |
| 3,932,295 | 1/1976 | Fujino et al. | 252/102 |
| 4,005,029 | 1/1977 | Jones | 252/99 |
| 4,006,092 | 2/1977 | Jones | 252/95 |
| 4,065,257 | 12/1977 | Coe et al. | 252/110 |
| 4,261,869 | 4/1981 | Bishop et al. | 252/542 |
| 4,348,305 | 9/1982 | Hennemann et al. | 252/542 |
| 4,547,306 | 10/1985 | Hase et al. | 252/99 |

FOREIGN PATENT DOCUMENTS

| | | |
|---|---|---|
| 1922450 | 11/1970 | Fed. Rep. of Germany . |
| 2232353 | 1/1973 | Fed. Rep. of Germany . |
| 2309099 | 9/1973 | Fed. Rep. of Germany . |
| 2420561 | 10/1975 | Fed. Rep. of Germany . |
| 2828619 | 1/1979 | Fed. Rep. of Germany . |
| 2733970 | 2/1979 | Fed. Rep. of Germany . |
| 3026090 | 2/1982 | Fed. Rep. of Germany . |
| 3124210 | 12/1982 | Fed. Rep. of Germany . |
| 2817834 | 5/1983 | Fed. Rep. of Germany . |
| 3202213 | 8/1983 | Fed. Rep. of Germany . |
| 1348212 | 3/1974 | United Kingdom . |

OTHER PUBLICATIONS

Encl. of Polymer Science & Tech. vol. 9, J. Wiley & Sons, Inc. NY (1968) Journal of Organic Chemistry of the USSR I:10, pp. 1765-1767 (1965).

*Primary Examiner*—Prince E. Willis
*Attorney, Agent, or Firm*—Ernest G. Szoke; Henry E. Millson, Jr.; Mark A. Greenfield

[57] ABSTRACT

Improved detergent compositions for colored fabrics containing an acylcyanamide salt and a water-soluble organic polymer whose monomers have more than one amino group, and which are substantially or completely free of strong electrolytes.

18 Claims, No Drawings

DETERGENT COMPOSITION FOR COLORED FABRICS

BACKGROUND OF THE INVENTION

1. Field of the Invention

This invention relates to a detergent composition suitable for washing colored fabrics, of which the surfactant component is a combination of nonionic surfactants with acyl cyanamide salts and which contains certain water-soluble polymers to prevent the transfer of dyes from colored fabrics to white or light-colored fabrics during the washing process.

2. Statement of the Related Art

The transfer of dyes during the washing of colored and white or light-colored fabrics is a well known problem to which some solutions have already been proposed. Unfortunately, these proposed solutions have not been entrirely satisfactory because of their limited effectiveness with respect to a number of colors and fabrics. Thus, British Pat. No. 1,348,212 (and corresponding German patent application No. 22 32 353) describes a detergent of which the discoloration inhibitor is polyvinyl pyrrolidone. U.S. Pat. No. 3,932,295 (and corresponding German patent application No. 24 20 561) describes a detergent comprising a combination of alkali metal percarbonate and polyethylene glycol having a certain molecular weight and/or polyvinyl pyrrolidone. U.S. Pat. No. 4,065,257 (and corresponding German patent application No. 23 09 099) describes a detergent incorporating two different organic compounds which contain basic nitrogen atoms in the molecule. U.S. Pat. Nos. 4,005,029 and 4,006,092 describe detergents containing "per" compounds as discoloration inhibitors.

According to published German patent application No. 30 26 090, cationic starch ethers are added to liquid detergents based on certain nonionic surfactants and fabric-softening quaternary ammonium compounds to prevent the transfer of dyes. U.S. Pat. No. 4,261,869 (and corresponding German patent application No. 28 28 619) describes a discoloration-inhibiting detergent of three different types of surfactant, namely (1) nonionic surfactants, (2) zwitterionic or semipolar surfactants and (3) cationic surfactants, which have to be present in certain quantitative ratios. Published German patent application No. 31 24 210 describes a liquid detergent based on nonionic or zwitterionic surfactants. This detergent contains certain water soluble polymers to prevent the transfer of dyes. A fabric detergent containing the same acylcyanamide salts, a builder, optional nonionic surfactants and optional other standard detergent ingredients is described in copending U.S. patent application Ser. No. 06/618,608 now U.S. Pat. No. 4,547,306, and corresponding German application No. P 33 20 726.7.

DESCRIPTION OF THE INVENTION

It has now been found that a detergent containing synthetic nonionic surfactants and water-soluble organic polymers and other standard detergent ingredients has a particularly good discoloration inhibiting effect providing it additionally contains acylcyanamide salts, and the water-soluble synthetic organic polymers are preferably compounds of monomers containing more than one amino group or reaction products thereof with aldehydes or dicarboxylic acids, and with a further proviso that the detergent is substantially or completely free from strong electrolytes.

Suitable water-soluble polymers for the detergent according to the invention, which may be used either individually or, preferably, in combination with one another or with the known discoloration inhibitor, polyvinyl pyrrolidone, are known synthetic compounds of the type used in the papermaking industry, for example, as retention agents to improve separation of the paper fiber raw materials and fillers. These polymers may be divided into four groups according to their structure, namely: polyethylene imines, polyamines, polyamine amides and polyacrylamides.

Suitable polyethylene imines are obtained by the acid-catalyzed polymerization of ethylene imine and may be modified by urea and epichlorohydrin or dichloroethane. Polyethylene imines may contain primary, secondary and tertiary amino groups and also quaternary ammonium groups. Aqueous solutions of polyethylene imines show a basic reaction. The molecular weight of the polyethylene imines may be up to 100,000.

Polyamines are adducts or condensates of polyfunctional aliphatic amines and compounds containing several reactive groups, for example epichlorohydrin or alkylene dihalides. They always contain several secondary, tertiary or even quaternary nitrogen atoms and possibly even hydroxyl groups in the molecule. Accordingly, they are hydrophilic, polar compounds which behave like polyelectrolytes and are soluble in water providing they do not contain any large hydrophobic groups in the molecule. In aqueous solution, the polyamines show a basic reaction. Suitable compounds are described, for example, in U.S. Pat. No. 2,969,302, incorporated herein by reference.

Polyamine amides contain both amino and amide groups in the molecule. They may be produced by the condensation of polybasic acids, such as dibasic, saturated, aliphatic $C_{3-8}$ acids, and polyamines and also with compounds containing several reactive groups, such as epichlorohydrin. These compounds also show a basic reaction in aqueous solution. Suitable polyamine amides are described, for example, in U.S. Pat. No. 2,926,154, incorporated herein by reference.

Suitable polyacrylamides are high molecular weight polymers having molecular weights of several million. The incorporation of carboxyl groups formed by partial hydrolysis, in addition to amide groups, gives anionic polyacrylamides. Polyacrylamides containing amino groups show a basic reaction in aqueous solution. Amino groups may be introduced by reaction with alkali and hypobromite or hypochlorite.

Of the polymers mentioned above, the polyethylene imines and polyamines which show a strongly basic reaction in water are particularly suitable. Examples of particularly suitable, commercially obtainable polyethylene imines are "Retaminol E" and, of polyamines, "Retaminol K", both trademarked products of Bayer AG, Leverkusen, Federal Republic of Germany.

The water-soluble reaction products of polyethylene or polypropylene imine (molecular weight 300–6,000) with certain polycarboxylic acids containing from 2 to 10 carbon atoms which are described as redeposition inhibitors in U.S. Pat. No. 3,663,444 (and corresponding German patent application No. 19 22 450) are also very suitable, U.S. Pat. No. 3,663,444 being incorporated herein by reference.

Other very suitable products are the water soluble reaction products of melamine, urea, dicyanodiamide or guanidine with formaldehyde, for example the products commercially available under the trademarks "Pressal R 50", "Melan 125" or "Stabifix WE" from Henkel, KGaA, Duesseldorf, Federal Republic of Germany.

Other polymers which may be used as retention agents in papermaking and which are suitable for the detergents according to the invention are described in the "Encyclopedia of Polymer Science and Technology", Vol. 9, pages 762–764 John Wiley & Sons Inc., New York, pub. (1968). An addition of these polymers to the detergents according to the invention also has a discoloration-inhibiting effect.

The concentration of the above polymers in a detergent composition according to the invention amounts to 1–15%, preferably 2–6%, by weight based on the total weight of the composition. The in-use concentration of the detergent amounts to between 1 and 10 g/l and preferably to between 3 and 6 g/l of wash liquor.

The detergent according to the invention should contain only a very small quantity, if any, of strong electrolytes. In the context of the present invention, "strong electrolytes" are understood to be the salts of strong bases with strong acids which in turn are understood to be, above all, soluble builder salts, such as alkali phosphates, sulfates and sulfonates, but not silicates or carbonates, or the alkali alumosilicates of the zeolite A, X, Y or P type known as waterinsoluble detergent builders. Heavy metal complexing agents of the polycarboxylate type, which also include aminopolycarboxylates, such as nitrilotriacetic acid or ethylene diamine tetraacetic acid or salts thereof with strong bases, are not strong electrolytes. By contrast, the known anionic sulfate or sulfonate surfactants are strong electrolytes. Thus, the detergent according to the invention is substantially or completely free from synthetic surfactants of the sulfate or sulfonate type and from soluble builder salts of the sulfate, sulfonate or phophate type. The substantial or complete absence of strong electrolytes contributes significantly toward the good discoloration-inhibiting effect of the detergent composition according to the invention. Strong electrolytes in the context of the present invention may be present in the detergent composition in a quantity of at most 5% by weight and preferably in a quantity of no more than 3.5% by weight.

The detergent according to the invention contains a combination of synthetic nonionic surfactants and acylcyanamide salts as its surfactant component.

Suitable nonionic surfactants are adducts of from 2 to 40 mols and preferably from 2 to 20 mols of ethylene oxide with 1 mol of fatty alcohol or oxoalcohol, alkylphenol, fatty acid, fatty amine, fatty acid amide or alkane sulfonamide. Particularly important in this respect are the adducts of from 5 to 16 mols of ethylene oxide with coconut oil or tallow fatty alcohols, with oleyl alcohol or with secondary $C_{8-18}$ and preferably $C_{12-18}$ alcohols and also with mono- or dialkylphenols containing from 6 to 14 carbon atoms in the alkyl residues. In addition to these water soluble nonionics, polyglycol ethers containing from 1 to 4 ethylene glycol ether residues in the molecule which are insoluble or incompletely soluble in water are also of interest, particularly if they are used in conjunction with water soluble nonionic surfactants or with small quantities of anionic surfactants.

Other suitable nonionic surfactants are the water soluble adducts containing from 20 to 250 ethylene glycol ether groups and from 10 to 100 propylene glycol ether groups, of ethylene oxide with polypropylene glycol, alkylene diamine polypropylene glycol, and alkyl polypropylene glycols containing from 1 to 10 carbon atoms in the alkyl chain, in which the polypropylene glycol chain acts as a hydrophobic residue.

Nonionic surfactants of the amine oxide or sulfoxide type may be used.

Acylcyanamide salts, which are used in combination with nonionic surfactants in the detergents according to the invention, are compounds corresponding to the following formula

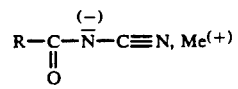

$$R-\underset{\underset{O}{\|}}{C}-\overset{(-)}{\overline{N}}-C\equiv N,\ Me^{(+)} \qquad (I)$$

in which Me is sodium or potassium and R is an alkyl or alkenyl radical containing from 9 to 23 carbon atoms which may be substituted by hydroxyl or alkoxy groups.

The acylcyanamide salts used in accordance with the invention may be obtained from carboxylic acid derivatives and cyanamide with subsequent neutralization using suitable bases (cf. German Pat. No. 708,428 or A. E. Kretov and A. P. Momsenko, *Zhur. Org. Khim* (*Journal of Organic Chemistry of the USSR*) I:10, pages 1765–1767 (1965).

They are easier to produce by reacting salts of cyanamide with carboxylic acid esters, as described in published German patent application No. 32 02 213. This process may also be of advantage for the further use of the acylcyanamide salts in the production of detergents and cleaners, because it gives the salts in anhydrous form.

Apart from being easy to produce, the acylcyanamide salts have the advantage that they can be produced from renewable raw materials, in this case fatty acid derivatives, and the cyanamide readily obtainable from nitrolime (calcium cyanamide). Accordingly, where these surfactants are used, the detergent manufacturer is not so dependent upon petroleum-based raw materials such as alkylbenzene sulfonate which is still the most important anionic surfactant. In addition, acylcyanamide salts show good biodegradability and are toxicologically acceptable.

Particularly favorable properties for the purposes of the present invention are shown by the sodium salts of the acylcyanamides, particularly those in which the radical R in formula I represents a substantially unsubstituted alkyl or alkenyl radical containing from 11 to 17 carbon atoms. Salts such as these may readily be obtained on a commercial scale from monosodium cyanamide and the methyl esters of natural fatty acid mixtures, such as tallow fatty acid methyl ester and palm kernel oil fatty acid methyl ester.

The acylcyanamide salts are used together with the nonionic surfactants, and a good detergent effect is obtained with detergent compositions which contain 1 to 30%, preferably 3 to 15%, by weight of acylcyanamide salts and 1 to 30% preferably 2 to 15%, by weight of at least one nonionic surfactant selected from the group comprising alcohol ethoxylates and alkyl phenol ethoxylates, in addition to other standard ingredients of detergents and cleaners, all percentages being based on the total weight of the composition.

Particularly strong detergency with respect to fatty and pigment-containing stains in conjuction with a pronounced discoloration-inhibiting effect is shown by detergents in which the acylcyanamide salts are present in combination with nonionic surfactants of the alcohol ethoxylate type.

In a liquid embodiment of the detergent composition according to the invention, which is preferred to powdered detergents, the surfactant component consists of a combination of two different nonionic surfactants, as described in U.S. Pat. No. 4,348,305 (and corresponding German patent application No. 28 17 834), and acylcyanamide salts corresponding to formula I. This particularly preferred detergent contains as nonionic surfactant a mixture of (a) from 5 to 18% by weight of an alkyl polyglycol ether corresponding to the formula

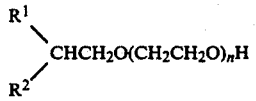

$$R^1, R^2 \diagdown CHCH_2O(CH_2CH_2O)_nH \quad \text{(II)}$$

in which $R^1$ is a straight-chain alkyl group; $R^2$ (to a level of from 20 to 75% by weight based on the alcohol of the alkyl polyglycol ether), is a $C_{1-4}$ alkyl group, and for the rest, hydrogen; the total number of carbon atoms in $R^1$ and $R^2$ amounting to between 11 and 15; and n has a value of from 5 to 9, being selected in such a way that the ethylene oxide content of the alkyl polyglycol ether amounts to between about 50 and 65% by weight, (b) from 5 to 18% by weight of an alkyl polyglycol ether corresponding to formula II, in which $R^1$ is a straight-chain alkyl group and $R^2$ is either hydrogen or to a level of from 20 to 75% by weight, based on the alcohol of the alkyl polyglycol ether, is a $C_{1-4}$ alkyl group and for the rest, hydrogen; the total number oF carbon atoms in $R^1$ and $R^2$ amounting to between 6 an 10; and n has a value of from 3 to 8, being selected in such a way that the ethylene oxide content of the alkyl polyglycol ether amounts to between about 55 and 70% by weight.

The quantitative ratio of (a) to (b) is preferably 0.5–2:1.

This mixture of nonionic surfactants is used in combination with (c) from 2.0 to 7.0% by weight of acylcyanamide salts corresponding to formula I, in which R is an alkyl or alkenyl radical containing from 9 to 23 and preferably from 11 to 17 carbon atoms, and Me is sodium or potassium, preferably sodium.

The alkyl polyglycol ethers of formula II suitable for use as component (a) are derived from alcohols of the type obtained by reacting linear olefins with carbon monoxide and hydrogen using the known oxo process, by hydroformylation and subsequent hydrogenation. Commercially available oxoalcohol mixtures which are suitable for the production of surfactant component (a) are, for example, the oxoalcohols obtainable under the trademark "Dobanol" from Deutsche Shell Chemie Gesellschaft, Germany, which contain approximately 25% by weight of 2-alkyl branchings. Other suitable oxoalcohols are the alcohol mixtures containing approximately 50 to 70% by weight of 2-alkyl branchings which are obtainable under the trademark "Synprol" from Imperial Chemical Industries Ltd., Great Britain. Other suitable products based on oxoalcohols are, for example, the various types of "Lutensol" products, a trademark of BASF, containing approximately 30 to 35% by weight of branched alcohols, and some of the "Lial" products, a trademark of Liquichimica S.p.A., containing approximately 60% by weight of branched alcohols.

Component (a) preferably consists of alkyl polyglycol ethers which are ethylene oxide condensates of the above-mentioned oxoalcohols containing from 13 to 15 carbon atoms for an average ethylene oxide content of approximately 55 to 65% by weight. Typical preferred products are, for example, "Dobanol" 45-7, of which at least 95% by weight consists of $C_{14-15}$ oxoalcohol with an average of 7 mols of ethylene oxide, and "Lutensol" A0-8, which is a $C_{13-15}$ oxoalcohol ethoxylate containing on average 8 mols of ethylene oxide.

Component (b) preferably consists of alkyl polyglycol ethers of which the alcohol base is a natural or synthetic primary fatty alcohol or oxoalcohol containing from 9 to 12 carbon atoms and having an ethylene oxide content of from about 60 to 70% by weight. Typical preferred products are the commercially available "Marlipal" KF (a trademark of Chemische Werk Huls), which is a $C_{10-12}$ fatty alcohol ethoxylate containing on average 6 mols of ethylene oxide, and "Lutensol" ON-70 (a trademark of BASF) which is a $C_{9-11}$ oxoalcohol ethoxylate containing on average 7 mols of ethylene oxide. Other fatty alcohols suitable as a basis for preferred alkyl polyglycol ethers are the commercially available products "Lorol" C - 8 to C - 12 (a trademark of Henkel KGaA).

The quantitative ratio of component (a) to component (b) critically determines the parameters of detergency and foaming behavior. Optimal results are obtained when the ratio of (a) to (b) is 0.5–2:1.

In general, component (a) and component (b) are used in a total quantity of 10 to 30% by weight, based on the total weight of the detergent, and preferably in a total quantity of 15 to 30% by weight.

Water is preferably used as the solvent for the preferred liquid detergent. However, organic solvents may also be used in quantities of up to 20% by weight and preferably in quantities of up to 16% by weight, based on the liquid detergent as a whole. Additional solvents such as these are either lower alkanols or lower diols or polyols, such as ethanol, isopropyl alcohol, ethylene glycol, propylene glycol or glycerin. Polyols containing ether bonds, such as methyl, ethyl, butyl or diethylene glycol or acetates thereof may also be used.

To improve the solubility of the surfactants, it is often advisable to use solution promoters (hydrotropes) in addition to or instead of the above-mentioned organic solvents. Urea is a suitable hydrotrope. Hydrotropes are added in quantities of from 2 to 12% by weight and preferably in quantities of from 3 to 9% by weight, based on the liquid detergent as a whole.

Many other auxiliaries, which likewise are generally active in small quantities, may be added to the detergent compositions according to the invention to improve certain properties.

Auxiliaries such as opacifiers and viscosity regulators are generally present in the detergent composition in a quantity of 0.05 to 2% by weight. These auxiliaries are esters of alkanols or partial esters of polyols with relatively long chain fatty acids, such as palmitic or stearic acid. A typical auxiliary is ethylene glycol stearate.

In general, formalin is used as preservative in a quantity of from 0.05 to 1% by weight.

Complexing agents for heavy metal ions may be added to prevent discoloration of the detergent compositions in the event of prolonged storage. This discoloration can be caused by impurities such as heavy metal ions, introduced at the production stage. Standard complexing agents are the sodium, potassium or triethanolamine salts of aminopolycarboxylic acids, such as ethylene diamine tetraacetic acid or nitrilotriacetic acid. They are used in quantities of from 0.1 to 1% by weight.

Suitable perfumes may be added, such as compounds having a flowery/fresh or fruity note or a note described as cosmetic or creamy.

Detergents which have both a cleaning and softening effect additionally contain from 1 to 10% by weight of fabric-softening compounds, such as nonionics or, preferably, quaternary ammonium compounds preferably derived from ammonia or imidazoline containing two $C_{10-24}$ alkenyl or alkyl radicals which may even be substituted or interrupted by heteroatoms.

A detergent composition particularly preferred for its balanced product properties has the following ingredients:

(a) 7.5 to 12.5% by weight of an alkyl polyglycol ether corresponding to formula II, in which $R^1$ and $R^2$ together contain from 11 to 13 carbon atoms, the average ethylene oxide content of the alkyl polyglycol ether amounting to between 55 and 65% by weight, (b) 7.5 to 12.5% by weight of an alkyl polyglycol ether corresponding to formula II, in which $R^1$ contains from 7 to 10 carbon atoms and $R^2$ represents hydrogen, the average ethylene oxide content of the alkyl polyglycol ether amounting to between 60 to 70% by weight, (c) 3.0 to 5.0% by weight of an acylcyanamide salt corresponding to formula I, in which R is a substituted alkyl or alkenyl radical containing from 11 to 17 carbon atoms and Me is sodium, (d) 1.0 to 6.0% by weight of water-soluble synthetic polyethylene imines and/or polyamines which show a strongly basic reaction in water, (e) 1.0 to 6.0% by weight of water-soluble polymeric reaction products of melamine and/or urea and/or dicyanodiamide and/or guanidine with formaldehyde, (f) remainder to 100% water and organic solvents and, optionally, other standard additives present in small quantities, such as dyes and perfumes, hydrotropic agents, complexing agents for heavy metal traces and also preservatives, opacifiers and viscosity regulators.

In addition to the surfactants, powder-form or granular detergents according to the invention generally contain at least one builder whose function is to enhance the detergent effect of the surfactants and to eliminate the adverse effects caused by the hardness of water. Suitable builders may be soluble or insoluble in water. Water-soluble compounds are, above all, alkali carbonate and alkali silicate and also organic compounds of the hydroxycarboxylic acid, aminocarboxylic acid, polycarboxylic acid, carboxyalkyl ether, polymeric polycarboxylic acid type and of the substituted and unsubstituted alkane di- and polyphosphonic acid type. Typical examples of compounds of these types are citric acid, nitrilotriacetic acid, mellitic acid, carboxymethyloxy succinic acid, polyacrylic acid, polymethacrylic acid, poly-alpha-hydroxy-acrylic acid, polymaleic acid and the corresponding copolymers and hydroxyethane diphosphonic acid. These compounds are generally used in the form of their water-soluble salts.

Particular practical significance has been acquired in recent years by the finely divided, cation-exchanging, exchanging crystalline, water-containing sodium alumosilicates which were described for the first time as phosphate substitutes in Canadian Pat. No. 1,036,455 (and corresponding German published patent application No. 24 12 837) and which correspond to the following composition:

$$0.7 \text{ to } 1.5Na_2O.\ AL_{23}.0.8 \text{ to } 6\ SiO_2$$

These finely divided, hydrated sodium alumosilicates, which have a calcium binding power of from 100 to 200 mg of CaO/g (based on the anhydrous substance) include in particular the zeolites NaA and NaX. On a large scale, zeolite NaA above all is used.

The builder component is generally present in the detergent according to the invention in a quantity of from 3 to 70% by weight. Individual builders, for example organic builders such as alkane polyphosphonates or aminocarboxylic acids, may even be present in much smaller quantities, i.e. in quantities of from 0.1 to 3% by weight.

The detergent according to the invention may also contain redeposition inhibitors. Suitable redeposition inhibitors are water-soluble, mostly organic colloids such as the water-soluble salts of polymeric carboxylic acids, glue, gelatin, salts of ether carboxylic acids or ether sulfonic acids of starch or cellulose or salts of acidic sulfuric acid esters of cellulose or starch. Water-soluble polyamides containing acid groups are also suitable for this purpose. Preferred redeposition inhibitors are carboxymethylated cellulose or starch in the form of their sodium salts, methyl celluloses and also polymers and copolymers of acrylic, methacrylic, or maleic acids. It is also possible to use soluble starch preparations and other starch products than those mentioned above, such as degraded starch, aldehyde starches, and the like. Dye-transfer inhibitors of the polyvinyl pyrrolidone type may also be present in the detergent according to the invention. In combination with the water-soluble polymers of detergents according to the invention, polyvinyl pyrrolidone may even enhance the dye-transfer-inhibiting effect. Accordingly, detergents additionally containing polyvinyl pyrrolidone are preferred.

To remove certain vegetable stains, bleaches may be present in the detergents according to the invention. Particularly suitable are known bleaches of the peroxide type, such as sodium perborate, sodium carbonate perhydrate, potassium peroxomonosulfate or organic percarboxylic acids. These bleaches may be used either individually or in combination with known stabilizers, such as magnesium silicate, sodium ethylene diamine tetraacetate or sodium salts or polyphosphonic acids, whose function is to prevent the premature decomposition of the per compounds by heavy metal salts and resulting damage to the fabrics.

In addition, bleach activators may be used together with the bleaches. Of the many activators proposed in the literature, particularly suitable types are anhydrides, carboxylic acid amides and carboxylic acid esters which have an acylating effect of $H_2O_2$ in the wash liquor and, in this way, intensify the bleaching power of the liquor. Examples of suitable activators are phthalic acid anhydride, tetraacetyl ethylene diamine, tetraacetyl glycol uril and pentaacetyl glucose.

The quantity of activators in the detergents amounts to no more than 1 equivalent and, more particularly, to between 0.1 and 1 equivalent, based on the quantity of per compound present. The per compounds themselves are preferably present in quantities of from 1 to 30% by weight.

In addition to the ingredients already mentioned, the detergents according to the invention may contain other standard additives, particularly, foam regulators, enzymes, perfume oils, microbicides and optical brighteners.

Suitable foam-inhibiting additives are, for example, soaps containing from 20 to 24 carbon atoms, long-chain alkyl melamines, low-foam nonionic surfactants, paraffin hydrocarbons, microcrystalline waxes and silicone foam inhibitors. Particular importance is attributed to foam-suppressing soaps and silicone compounds, i.e. in this case, too, polysiloxanes activated by finely particulate $SiO_2$.

An addition of 20% by weight is always sufficient for effective foam regulation, an addition of from 0.05 to 10% by weight being preferred.

Any enzymes capable of intensifying the detergent effect, such as proteases, lipases and amylases, may be present as enzymes in the detergents according to the invention. It is preferred to use enzymes which develop an optimum effect at a pH-value in the range reached in the practical application of the detergents, and enzymes of the type which retain their effect, even at elevated temperatures.

Microbicides may be ingredients of detergents which are additionally intended to develop a disinfecting effect in their practical application. Suitable microbicides are any of the usual bactericides and fungicides providing they are compatible with the other ingredients of the detergents.

Optical brighteners are used in the detergents according to the invention when the detergents are also intended optically to increase the whiteness of the treated articles. Numerous compounds have been described in the literature as suitable for this purpose. Particularly suitable optical brighteners for fabric detergents are derivatives of diaminostilbene disulfonic acid and salts therof, for example 4,4'-bis(2-anilino-4-morpholino-1,3,5-triazin-6-yl-amino) stilbene-2,2'-disulfonic acid and brighteners of the substituted 4,4'-distyrilbiphenyl type, for example 4,4'-bis-(4-chloro-3-sulfostyryl)-biphenyl.

The detergents according to the invention may be produced by any of the processes normally used for producing conventional detergents. In the most simple case, solid detergents may be produced simply by mixing the powder-form or granular individual ingredients. Products which show better flow properties and which, in addition, contain less dust are obtained by granulation or by spray drying. In every case, production of the detergents is considerably simplified by using the acylcyanamide salts in anhydrous form in which they may readily be produced on a commercial scale. In addtion, the favorable temperature stability of the acylcyanamide salts also has a positive effect in the spray drying process. Paste and liquid detergents may also be produced by conventional processes. In general, the starting materials are both predissolved and also solid ingredients which may optionally be mixed with more solvent, generally water, and homogenized. It is possible by applying heat and mechanical energy to accelerate the homogenization process which is in any case facilitated to a considerable extent by the high solubility of the acylcyanamide salts. To dissolve other organic ingredients, it may be advisable to add water-miscible organic solvents, such as ethanol or isopropanol, while the addition of hydrotropes may be advisable for adjusting certain viscosities.

EXAMPLES

The following Examples describe compositions of some detergents which correspond to the invention and others which do not. For reasons of space, some ingredients which are not essential to the invention, such as perfume, enzymes, water, stabilizers, builders, preservatives and dyes, have not been listed. The acronyms and abbreviations used in the Tables have the following meanings:

OA-EO: $C_{14-15}$ oxoalcohol ethoxylate containing on average 58% by weight of ethylene oxide ("Dobanol" 45-7 a trademark of Deutsche Shell Chemie)

FA-EO: $C_{10-12}$ fatty alcohol ethoxylate containing on average 60% by weight of ethylene oxide ("Marlipal KF", a trademark of Chem. Werke Huls, Germany).

TA 5: tallow alcohol ethoxylate containing 5 mols of ethylene oxide,

TA 14: tallow alcohol ethoxylate containing 14 mols of ethylene oxide,

AMS-T, AMS-HT, AMS-ST: acylcyanamide sodium salts of formula I based on tallow fatty acid (T), hydrogenated tallow fatty acid (HT), stearic acid (ST), CMC: redeposition inhibitor based on carboxymethyl cellulose and methyl cellulose, SASIL: sodium alumosilicate of the zeolite NaA type, EDTA: ethylene diamine tetraacetic acid sodium salt, HEDP: disodium salt of 1-hydroxyethane-1, 1-diphosphonic acid, Soap: mixture of salts of long-chain $C_{16-22}$ fatty acid, PB: technical sodium perborate tetrahydrate, DMDSTAC: dimethyl distearylammonium chloride, LM: solvent mixture of ethanol and 1,2-propylene glycol, MGS: magnesium silicate, WG: sodium silicate having the composition $Na_2O$. 3.35 $SiO_2$, RK: 25% aqueous solution of a polyamine showing a strongly basic reaction ("Retaminol" K a trademark of Bayer, AG Germany), MEL: melamine-formaldehyde condensate, molar ratio 1:5 ("Melan" 125, a trademark of Henkel KGaA, F.R. Germany), PR: melamine-urea-formaldehyde condensate ("Pressal" 50 a trademark of Henkel KGaA, F.R. Germany), STA: dicyanodiamide-formaldehyde condensate ("Stabifix" WE, a trademark of Henkel KGaA, F.R. Germany), ANZ: condensates of adipic acid and polyethylene imine, molecular weight 900 (=ANZ 145) or 600 (=ANZ 148), molar ratio 1:1.

EXAMPLES 1 to 5

These Examples show how the discoloration-inhibiting effect of a liquid detergent based on nonionic surfactants is enhanced by the combination according to the invention of nonionic surfactants, acylcyanamide salts and certain water-soluble polymers. Example 1 relates to a known liquid detergent without any acylcyanamide salts or water-soluble polymers. White test fabrics of cotton-terry (C) and refined-cotton (Cr), were washed with this detergent in a Miele W 433 automatic drum-type washing machine filled with water at 60° C. (hardness 16° d). The test fabrics were washed in 20 liters of water together with 3.5 kg of clean washing and a cloth, which had been dyed with Siriuslichtrot F 4 BL (an intensive dye with a pronounced tendency towards transfer). Washing was carried out by the one-step process. The remission in percent was then determined as a measure of the discoloration of the washed and dried test fabrics. Remission was measured with a type RFC 3/18 photometer with a 46 (460 nm) filter. The result is a measure of the dye transfer of a state-of-the-art detergent. Examples 2 and 3 relate to detergents containing acylcanamide salts. Examples 4 and 5 relate to detergents according to the invention containing a combination of nonionic surfactants, acylcyanamide salts and water soluble salts. The detergents had the following compositions:

TABLE I

| Essential | comparison | | | this invention | |
|---|---|---|---|---|---|
| Ingredients | 1 | 2 | 3 | 4 | 5 |
| OA-EO | 9.5 | 9.5 | 9.5 | 9.5 | 9.5 |
| FA-EO | 9.5 | 9.5 | 9.5 | 9.5 | 9.5 |
| AMS-ST | — | 3.4 | — | 3.4 | — |
| AMS-HT | — | — | 3.4 | — | 3.4 |
| RK | — | — | — | 3.5 | 3.5 |
| MEL | — | — | — | 1.8 | 1.8 |
| PR | — | — | — | 1.8 | 1.8 |

The remission of the washed test fabrics C and Cr is shown in Table II.

TABLE II

| | 1 | 2 | 3 | 4 | 5 |
|---|---|---|---|---|---|
| C | 74.9 | 74.6 | 75.1 | 79.7 | 79.2 |
| Cr | 82.8 | 83.1 | 82.8 | 85.0 | 86.5 |

The detergent according to the invention of Examples 4 and 5 show a distinctly better discoloration-inhibiting effect than the detergents without water-solution polymers (Examples 1 to 3). If more than 5% by weight of strong electrolyte was added to the detergents, discoloration was distincly intensified.

EXAMPLES 6 TO 10

The liquid detergents of Example 6 is a state-of-the-art detergent which was compared with the detergents according to the invention of Examples 7 to 10 in another series of tests conducted with the test fabrics cotton (C), polyamide (PA) and polyurethane/polyamide (PUA), in the same way as in Examples 1 to 5. The detergents had the following compositions:

TABLE III

| Essential | comparison | this invention | | | |
|---|---|---|---|---|---|
| Ingredients | 6 | 7 | 8 | 9 | 10 |
| OA-EO | 9.5 | 9.5 | 9.5 | 9.5 | 9.5 |
| FA-EO | 9.5 | 9.5 | 9.5 | 9.5 | 9.5 |
| AMS-HT | — | 3.4 | 3.4 | — | — |
| AMS-ST | — | — | — | 3.4 | 3.4 |
| RK | — | 1.8 | — | 1.8 | — |
| ANZ-148 | — | — | 1.8 | — | 1.8 |
| STA | — | 1.8 | 1.8 | 1.8 | 1.8 |

The remission of the test fabrics C, PA and PUA is shown in Table IV.

TABLE IV

| | 6 | 7 | 8 | 9 | 10 |
|---|---|---|---|---|---|
| C | 61.7 | 86.1 | 84.0 | 86.0 | 84.4 |
| PA | 77.7 | 83.6 | 84.3 | 84.4 | 82.8 |

TABLE IV-continued

| | 6 | 7 | 8 | 9 | 10 |
|---|---|---|---|---|---|
| PUA | 50.1 | 77.4 | 78.6 | 79.2 | 80.4 |

The detergents according to the invention of Examples 7 to 10 give distinctly less discolored test fabrics than the state-of-the-art detergent. An addition of anionic surfactant produced a distinct increase in discoloration.

EXAMPLE 11 to 17

Example 11 relates to a liquid, softening state-of-the-art light-duty detergent containing dimethyl distearyl ammonium chloride as its fabric-softening component. As in the preceding Examples, cotton and polyurethane/polyamide test fabrics were washed with this detergent and, for comparison, with detergents according to the invention. The essential constituents of the detergents and the remission values for discoloration are shown in Tables V and VI

TABLE V

| Essential | comparison | this invention | | | | | |
|---|---|---|---|---|---|---|---|
| Ingredients | 11 | 12 | 13 | 14 | 15 | 16 | 17 |
| OA-EO | 9.5 | 9.5 | 9.5 | 9.5 | 9.5 | 9.5 | 9.5 |
| FA-EO | 9.5 | 9.5 | 9.5 | 9.5 | 9.5 | 9.5 | 9.5 |
| DMDSTAC | 4.0 | 4.0 | 4.0 | 4.0 | 4.0 | 4.0 | 4.0 |
| AMS-ST | — | 3.4 | 3.4 | — | — | — | — |
| AMS-HT | — | — | — | 3.4 | 3.4 | — | — |
| AMS-T | — | — | — | — | — | 3.4 | 3.4 |
| RK | — | 1.8 | — | 1.8 | — | 1.8 | — |
| STA | — | 1.8 | 1.8 | 1.8 | 1.8 | 1.8 | 1.8 |
| ANT 148 | — | — | 1.8 | — | 1.8 | — | 1.8 |

TABLE VI

| | 11 | 12 | 13 | 14 | 15 | 16 | 17 |
|---|---|---|---|---|---|---|---|
| C | 79.4 | 86.2 | 86.2 | 86.3 | 86.4 | 82.4 | 83.4 |
| PUA | 73.5 | 77.0 | 78.7 | 79.4 | 79.6 | 78.8 | 78.1 |

The softening light-duty detergent of Examples 12 to 17 also shows the striking inhibition of discoloration characterisitc of the detergents according to the invention.

EXAMPLES 18 to 22

The powered detergents of Examples 18 to 20 are detergents without any water-soluble polyers, of which the detergents of Examples 19 and 20 contain nonionic surfactants and acylcyanamide salts as surfactant, while the detergent of Example 18 merely contains nonionic surfactants (of Table VII). The powder-form detergents of Examples 21 and 22 are detergents according to the invention.

TABLE VII

| Essential | comparison | | | this invention | |
|---|---|---|---|---|---|
| Ingredients | 18 | 19 | 20 | 21 | 22 |
| TA 14 | 4.5 | 4.5 | 4.5 | 4.5 | 4.5 |
| TA 5 | 10.5 | 10.5 | 10.5 | 10.5 | 10.5 |
| Soap | 1.5 | 1.5 | 1.5 | 1.5 | 1.5 |
| CMC | 1.0 | 1.0 | 1.0 | 1.0 | 1.0 |
| EDTA | 0.2 | 0.2 | 0.2 | 0.2 | 0.2 |
| WG | 2.5 | 2.5 | 2.5 | 2.5 | 2.5 |
| MGS | 1.0 | 1.0 | 1.0 | 1.0 | 1.0 |
| PB | 20.0 | 20.0 | 20.0 | 20.0 | 20.0 |
| HEDP | 1.35 | 1.35 | 1.35 | 1.35 | 1.35 |
| SASIL | 35.0 | 35.0 | 35.0 | 35.0 | 35.0 |
| AMS-ST | — | 3.5 | — | 3.5 | — |
| AMS-HT | — | — | 3.5 | — | 3.5 |

TABLE VII-continued

| Essential Ingredients | comparison 18 | 19 | 20 | this invention 21 | 22 |
|---|---|---|---|---|---|
| RK | — | — | — | 3.5 | 3.5 |
| MEL | — | — | — | 1.8 | 1.8 |
| PR | — | — | — | 1.8 | 1.8 |

In the same way as before, washing tests were conducted with these detergents using cotton-terry fabrics (C) and polyamide fabrics (PA) as the test fabrics. The remission values are shown in Table VIII.

TABLE VIII

| | 18 | 19 | 20 | 21 | 22 |
|---|---|---|---|---|---|
| C | 63.0 | 61.8 | 56.0 | 67.7 | 67.5 |
| PA | 69.9 | 67.2 | 70.2 | 75.5 | 75.9 |

An addition of acylcyanamide salts (Examples 19 and 20) to the basic formulation (Example 18) produces some increase in dye transfer. This increase is not only counteracted by the detergents according to the invention, it is actually overcompensated, as reflected in distinctly higher remission values (Examples 21 and 22).

EXAMPLES 23 to 25

In the same way as Examples 18 to 22, the following Examples 23 to 25 illustrate the discoloration-inhibiting effect of powdered detergents according to the invention (24 and 25) by comparison with a known detergents 23 (see Tables IX and X).

TABLE IX

| Essential Ingredients | comparison 23 | this invention 24 | 25 |
|---|---|---|---|
| TA 14 | 4.5 | 4.5 | 4.5 |
| TA 5 | 10.5 | 10.5 | 10.5 |
| Soap | 1.5 | 1.5 | 1.5 |
| CMC | 1.0 | 1.0 | 1.0 |
| EDTA | 0.2 | 0.2 | 0.2 |
| WG | 2.5 | 2.5 | 2.5 |
| MGS | 1.0 | 1.0 | 1.0 |
| PB | 20.0 | 20.0 | 20.4 |
| HEDP | 1.35 | 1.35 | 1.35 |
| SASIL | 35.0 | 35.0 | 35.0 |
| AMS-HT | — | 3.5 | 3.5 |
| PR | — | 1.8 | — |
| STA | — | 1.8 | 1.8 |
| ANZ 145 | — | — | 1.8 |

TABLE X

| | 23 | 24 | 25 |
|---|---|---|---|
| C | 38.8 | 73.8 | 84.1 |
| Cr | 57.2 | 77.0 | 81.7 |

The discoloration-inhibiting effect of these powdered detergents is again clearly apparent against the state-of-the-art detergent.

We claim:

1. In a detergent composition for colored fabrics, containing at least one synthetic surfactant and at least one water soluble organic polymer, the improvement wherein:

said at least one surfactant is nonionic, is present in about 1–30%, and contains from 0 to not more than 5% of strong electrolytes;

said at least one water soluble organic polymer is present in about 1–15% and is selected from: polyethylene imine or polypropylene imine, having a molecular weight up to 100,000; polyamine which contains several secondary, tertiary, or quaternay nitrogen atoms in the molecule; polyamine amide which is produced by the condensation of a polybasic acid and a polyamine; polyacryamice having a molecular weight of several million; the reaction product of any of the foregoing polymers with an aldehyde or a polycarboxylic acid; or the reaction product of melamine, urea, discyanodimide, or guanidine with formaldehyde; and at least one acylcyanamide salt is present in about 1–30%, having the formula:

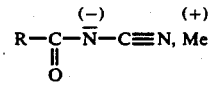

wherein

Me is sodium or potassium, and

R is a $C_{9-23}$-alkyl or alkenyl, which may be substituted by hydroxyl or alkoxy groups;

all percentages being by weight and based upon the total weight of said composition.

2. The composition of claim 1 wherein said organic polymers are at least one of said:

polyethylene imine or polyamine;

reaction product of polyethylene imine or polypropylene imine with a polycarboxylic acid; or reaction product of melamine, urea, dicyanodiamide or guanidine with formaldehyde.

3. The composition of claim 2 wherein R is a $C_{11-17}$ alkyl or alkenyl which is substantially unsubstituted and Me is sodium.

4. The composition of claim 2 further containing polyvinyl pyrrolidone.

5. The composition of claim 2 wherein said organic polymers are present in about 2–6%, said acylcyanamide salts are present in about 3–15%, and said nonionic surfactants are present in about 2–15%, all percentages being by weight based upon the total weight of the composition.

6. The detergent composition of claim 2, wherein said nonionic surfactants are:

(a) a first alkyl polyglycol ether of the formula:

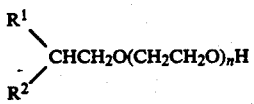

wherein:

$R^1$ is a straight chain alkyl;

$R^2$ is $C_{1-4}$ alkyl derived from the alcohol of said first ether to a level of 20 to 75% by weight, and hydrogen at a level to balance to 100%; the total number of carbon atoms in $R^1+R^2$ being 11 to 15; and n is 5 to 9 and is selected so that the average ethylene content of said first ether is 50–65% by weight, based upon the total weight of said first ether; and (b) a second alkyl polyglycol ether of the same formula as (a) in which $R^1$ is as defined in (a); $R^2$ is either hydrogen or as defined in (a); the total number of carbon atoms in $R^1+R^2$ is between 6 and 10 and n is 3 to 8 and is selected so that the average ethylene oxide content of said second ether is 55–70% by weight based upon the total weight of said second ether, the weight ratio of (a):(b) being 0.5–2:1.

7. The composition of claim 1 wherein R is a $C_{11-17}$ alkyl or alkenyl which is substantially unsubstituted and Me is sodium.

8. The composition of claim 1 further containing polyvinyl pyrrolidone.

9. The composition of claim 1 wherein said organic polymers are present in about 2–6%, said acylcyanamide salts are present in about 3–15%, and said nonionic surfactants are present in about 2–15%, all percentages being by weight based upon the total weight of the composition.

10. The detergent composition of claim 1 wherein said nonionic surfactants are:

(a) a first alkyl polyglycol ether of the formula:

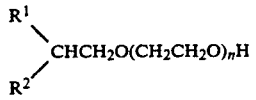

wherein:

$R^1$ is a straight chain alkyl;

$R^2$ is $C_{1-4}$ alkyl derived from the alcohol of said first ether to a level of 20 to 75% by weight, and hydrogen at a level to balance to 100%; the total number of carbon atoms in $R^1+R^2$ being 11 to 15; and n is 5 to 9 and is selected so that the average ethylene content of said first ether is 50–65% by weight, based upon the total weight of said first ether; and (b) a second alkyl polyglycol ether of the same formula as (a) in which $R^1$ is as defined in (a); $R^2$ is either hydrogen or as deFined in (a); the total numher of carhon atoms in $R^1+R^2$ is belween 6 and 10 and n is 3 to 8 and is selected so that the average ethylene oxide content of said second ether is 55–70% by weight based upon the tota! weight of said second ether, the weight ratio of (a):(b) being 0.5–2:1.

11. The composition of claim 6 wherein (a) and (b) are each independently present in about 5–18% and said acylcyanamide salt is present in about 2–7%, all percentages being by weight based upon the total weight of said composition.

12. The composition of claim 1 further containing about 1–10% of fabric-softening quaternary ammonium compounds containing two $C_{10-24}$-alkyl or alkenyl radicals derived from ammonia or imidazoline, said percentage being by weight based upon the total weight of the composition.

13. The composition of claim 1 in powder or granular form and further containing 3–70% of cation-exchanging crystalline sodium aluminosilicate builder, said percentage being by weight based upon the total weight of the composition.

14. The composition of claim 13 wherein said builder is zeolite NaA.

15. The composition of claim further containing 0.1–3% of organic builders, said percentage being by weight based upon the total weight of the composition.

16. The composition of claim 10 further containing a standard detergent auxiliary ingredient which comprises at least one of: redeposition inhibitors, bleaching compounds, bleach activators, foam regulators, enzymes, perfume oils, microbicides or optical brighteners.

17. A liquid detergent composition for colored fabrics consisting essentially of:

(a) 7.5–12.5% of first alkyl polyglycol ethers of the formula

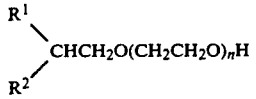

wherein:

$R^1$ is a straight chain alkyl;

$R^2$ is a mixture of $C_{1-4}$ alkyl derived from the alcohol of said first ether to a level of 20 to 75% by weight, and hydrogen at a level to balance to 100%; the total number of carbon atoms in $R^1+R^2$ being 11 to 13; and n is 5 to 9 and selected so that the average ethylene oxide content of said first ether is 55 to 65% by weight based upon the total weight of said ether;

(b) 7.5–12.5% of a second alkyl polyglycol ether of the same formula as (a) in which $R^1$ is a $C_{7-10}$-straight chain alkyl, $R^2$ is hydrogen, and n is 3 to 8 and is selected so that the average ethylene oxide content of said second ether is 60–70% by weight based upon the total weight of said second ether;

(c) 3.0–5.0% of an acylcyanamide salt of the formula

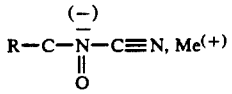

wherein:

R is a $C_{11-17}$ unsubstituted alkyl or alkenyl; and

Me is sodium;

(d) 1.0–6.0% of water-soluble synthetic polyethylene imines and/or polyamines, showing a strongly basic reaction in water;

(e) 1.0–6.0% of water-soluble polymeric reaction products of at least one of melamine, urea, dicyanodiamide or guanidine with formaldehyde;

(f) small amounts of at least one auxiliary ingredient comprising: redeposition inhibitors; bleaching compounds; bleach activators; foam regulators; enzymes; perfume oils; microbicides; or optical brighteners; and (g) q.s. to 100% of water and/or organic solvents;

the percentages of (a) through (g) all being by weight based upon the total weight of said composition, and which composition contains from 0 to not more than 5% by weight strong electrolytes.

18. The composition of claim 17 wherein component:

(a) is (i):a $C_{14-15}$ oxoalcohol ethoxylate containing on average 58% by weight of ethylene oxide;

(ii)a $C_{10-12}$ fatty alcohol ethoxylate containing on average 60% by weight of ethylene oxide; or (iii)a mixture of (i) and (ii);

(b) is:

(i) a tallow alcohol ethoxylate containing about 5 mols of ethylene oxide;

(ii) a tallow alcohol ethoxylate containing about 14 mols of ethylene oxide; or (iii) a mixture of (i) and (ii);

(c) is an acycyanamide sodium salt and R is derived from: tallow fatty acid; hydrogenated tallow fatty acid; stearic acid; or any mixture thereof;

(d) is a 25% aqueous solution of a polyamine showing a strongly basic reaction;

(e) is:

(i) a melamine:formaldehyde condensate with a mol ratio of 1:5;

(ii) a melamine:urea:formaldehyde condensate;

(iii) a dicyanodiamide:formaldehyde condensate;

(iv) condensates of adipic acid:polyethylene imine in a mol ratio of 1:1 and a molecular weight of 600 and/or 900; or (v) a mixture of any of (i) to (iv);

(f) is:

(i) a redeposition inhibitor based upon carboxymethyl cellulose and methyl cellulose;

(ii) a sodium aluminosilicate of the zeolite NaA type;

(iii) ethylene diamine tetraacetic acid sodium salt;

(iv) 1-hydroxyethane-1,1-disphosphonic acid disodium salt;

(v) a soap which is a mixture of $C_{16-22}$ long chain fatty acid salts;

(vi) technical sodium perborate tetrahydrate;

(vii) dimethyl distearylammonium chloride;

(viii) magnesium silicate;

(ix) sodium silicate of the formula $Na_20.3.35SiO_2$; or (x) any mixture of (i) to (ix); and (g) is: water and/or a solvent mixture of ethanol and 1,2-propylene glycol.

* * * * *